US005517006A

United States Patent [19]

Fredriksson et al.

[11] Patent Number: 5,517,006

[45] Date of Patent: May 14, 1996

[54] MICROWAVE OVEN WITH A DOOR LOCKING SYSTEM

[75] Inventors: Ove Fredriksson, Soderkoping; Mats Ringborg, Kimstad, both of Sweden

[73] Assignee: Whirlpool Europe B.V., Veldhoven, Netherlands

[21] Appl. No.: 371,331

[22] Filed: Jan. 11, 1995

[30] Foreign Application Priority Data

Jan. 12, 1994 [SE] Sweden ..... 9400063

[51] Int. Cl.[6] ..... H05B 6/68

[52] U.S. Cl. ..... 219/723; 219/724; 126/197; 292/DIG. 69; 49/31

[58] Field of Search ..... 219/723, 722, 219/724, 702, 413; 126/197, 192; 99/467, 451; 49/31; 292/DIG. 69; 200/50 A, 61.62

[56] References Cited

U.S. PATENT DOCUMENTS

| | | | |
|---|---|---|---|
| 3,898,412 | 8/1975 | Robinson et al. . | |
| 3,967,088 | 6/1976 | Horiuchi . | |
| 4,498,695 | 2/1985 | Pardo | 292/260 |
| 4,543,748 | 10/1985 | North, Jr. | 49/395 |
| 4,749,835 | 6/1988 | Fukumoto . | |
| 4,840,287 | 6/1989 | Brewer et al. | 99/403 |
| 4,995,313 | 2/1991 | Delau et al. | 99/467 |
| 5,206,479 | 4/1993 | Zakaria et al. | 219/723 |
| 5,313,738 | 5/1994 | Thakur et al. | 49/394 |

*Primary Examiner*—Philip H. Leung
*Attorney, Agent, or Firm*—Robert O. Rice; Mark A. Davis

[57] ABSTRACT

A microwave oven having a cavity and a door for closing off the cavity. The oven is fitted with a pressure actuated safety catch device which prevents opening of the door as a consequence of a sudden pressure increase in the cavity. The sudden pressure increase in the cavity is used to activate the safety catch device which catches the locking device of the door.

8 Claims, 3 Drawing Sheets

MICROWAVE OVEN WITH A DOOR LOCKING SYSTEM

BACKGROUND OF THE INVENTION

1. Field of the Invention

The present invention relates to a microwave oven comprising a cavity, a door for closing off the cavity and a locking device for locking and/or retaining the door, the locking device comprising a movable locking member which is activated by the movement of the door to assume a locked position and an unlocked position upon closing and opening the door, respectively.

2. Description of the Related Art

Locks for microwave oven doors may be provided in a number of ways. Many types of lock rely upon a locking device fitted with a catch-like locking pawl. A disadvantage with this type of locking device is that the locking pawl always assumes a catched locked position when the door is closed, wherein it is necessary to provide the door with a locking button or handle which must be operated when opening the door in order release the locking pawl, whereupon the door can then be opened. See for example U.S. Pat. No. 3,907,088.

Another possibility is to utilize a rocker device or a balance arm construction as a locking device, see for example U.S. Pat. No. 4,749,835 and SE 9202977-6. The advantage attained with these solutions, in comparison to the locking devices above, is that they admit of simple and direct opening of the door without a lock button or handle being needed. However, a problem with such locking devices utilizing rocker or balance arm constructions can be that in certain cases a secure catched position is not obtained. During normal use of the oven, this is not a disadvantage, but rather an advantage as mentioned above, but certain situations are conceivable when it is desirable that the door has a catch function against direct opening during use of the oven. One such situation, for example, is if an explosion should occur in the oven cavity. This explosion may arise due to a food item, such as baked potatoes for example, being cooked at too high a power and/or for far too long a time. The explosion creates a sudden pressure increase in the form of a pressure wave in the cavity and may result in a very hasty or rapid opening of the door, whereupon fire may then spread from the oven. Ovens undergo safety tests in certain countries against this type of occurence, requirements being set for ovens that the door should remain closed and limit any fire present to the oven cavity.

SUMMARY OF THE INVENTION

The object of the present invention is to provide a locking device for microwave oven doors which, in the normal course of events assumes a non-barred locked position when the door is closed, whereby lock buttons and handles are not required to open the door, and which additionally provides a catch function upon rapid opening of the door, which may, for example, be caused by an explosion in the oven, as mentioned above.

The object of the invention is attained in a microwave oven of the type defined in the introduction, which according to the invention is characterized by a safety catch device for catching the opening movement of the door when a sudden pressure increase arises in the cavity, which safety catch device comprises pressure receptive means which is receptive to the pressure in the cavity and catch means which is activated by the pressure receptive means to assume an catched position which bars the locking device during said sudden pressure increase, thereby preventing opening of the door.

Several embodiments of the invention are conceivable. Accordingly, one microwave oven as defined above is further characterized in that the pressure receptive means is movable and is constituted by the door, the catch means is constituted by a movable catch pawl, and the safety catch device further comprises an inertia device which is movably attached to the locking device and a catch member which is fixedly disposed in relation to the locking device, the catch pawl being arranged to be activated by relative movement between the locking member and the inertia body and which normally assumes a non-catched stand-by position and assumes a catched position in engagement with the catch member when the pressure increase occurs and creates said relative movement, whereby continued opening of the door is prevented.

The locking member is preferably constituted by a rocker wheel or a balance arm. The catch device is integrated with the primary functions of the lock device to provide retention of the door and operation of the electricity switch when the locking member is constituted by a rocker wheel, as clarified below. To bring about relative motion between the locking member and inertia body, the inertia body must be movably attached to the locking member. The inertia body may be designed and attached to the locking member in several ways in which it can be made to execute a translational movement or a rotational movement when the catched position is to be asumed.

The microwave oven defined above is preferably characterized in that the inertia body is rotatably arranged, adjacent the catch pawl, around a rotation axle and the catch pawl is rotatably arranged, between the locking member and the inertia body, around pivot pins respectively disposed on the locking member and inertia body, which catch pawl executes a relative rotation in relation to the inertia body when the pressure increase occurs, whereby the catched position is assumed and continued opening of the door is prevented.

When the locking member is constituted by a rocker wheel, the rotation axles of the rocker wheel and inertia body preferably coincide with each other.

A further embodiment of a microwave oven is characterized in that the pressure receptive means is constituted by a a piston device which is arranged adjacent the wall of the cavity in a space having an opening into the cavity, the catch means is constituted by a catch pin which is disposed adjacent the piston means, and the safety catch device furhter comprises retaining means which produce a retaining force which acts on the piston means and retains the catch pin in a non-catched standby position, the piston means with associated catch pin normally assuming a standby position, while the catched position is assumed when the pressure increase occurs and causes the piston means to overcome said force, whereby the catch pin is brought into engagement with the locking member and prevents opening of the door.

As an alternative to the above embodiments, the pressure increase may be sensed by electronic means, this microwave oven being characterized in that the pressure receptive means is constituted by electronic pressure receptive means, such as a piezoelectric element, which is disposed in a space in the wall of the cavity adjacent an opening in the wall, the pressure receptive means generating an electric signal in response to a pressure increase in the oven, which signal controls means for causing the catch means to assume the catched position in engagement with the locking member, whereby opening of the door is prevented.

BRIEF DESCRIPTION OF THE DRAWINGS

Preferred embodiments of the present invention will be described by way of example below with reference to the accompanying drawings, in which.

DESCRIPTION OF THE PREFERRED EMBODIMENT

Figure 1A:
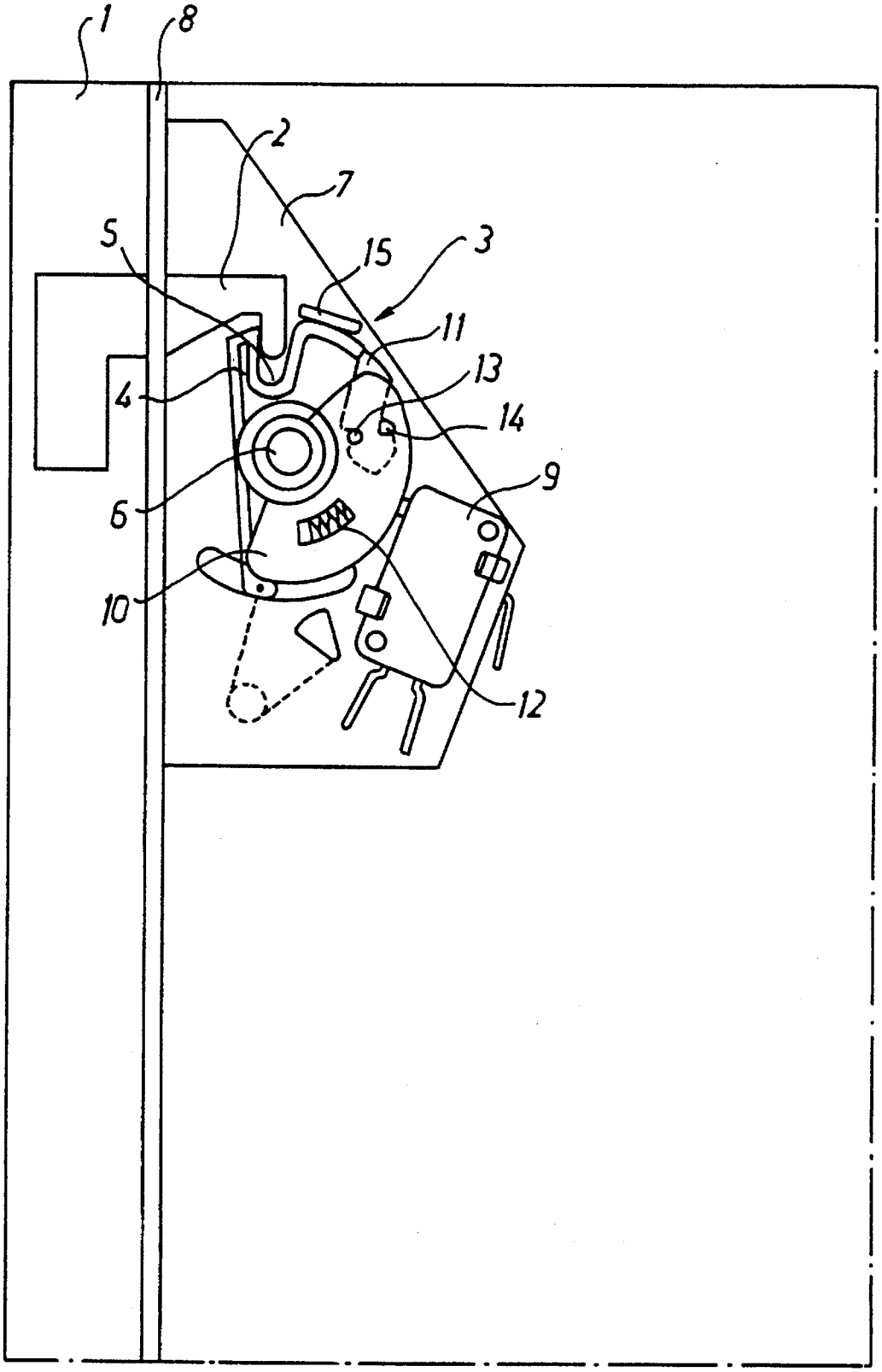
FIG. 1*a–b* schematically depicts a side view of a microwave oven fitted with a lock device which has a catch function and FIG. 1*c* depicts a rocker wheel, a catch pawl, a spring and an inertia body, and how they are arranged with respect to each other.

FIG. 1*a* schematically depicts a part of a microwave oven seen from the side. A door 1 having a locking catch 2 associated therewith is shown with the door closed. The lock device 3 comprises a rocker wheel 4. This type of lock device is used, inter alia, on side-hung doors.

When the door is closed, the locking catch 2 passes through an opening (not depicted) on the front 8 of the oven. Behind the opening, a locking device 3 is arranged, the locking pawl being received in a recess 5 in the rocker wheel 4. The rocker wheel is rotatably arranged around an axle 6 which projects from a lock housing 7. The lock housing is in turn secured to the front 8 of the microwave oven. When the door is closed, the locking pawl thus acts on the rocker wheel 4 whereby it is rotated around the axle 6 and assumes the position depicted in FIG. 1*a*. When the door is opened, the rocker wheel is again acted on by the locking pawl, whereby the rocker wheel is rotated back and assumes a standby position (not depicted).

It should be noted that this type of locking device does not utilize lock buttons or handles to be able to open the door, which allows for simple and hassle-free use of the oven.

The locking device does not only provide for retention of the door, but also operates one or more switches 9 by means of the rocker wheel as it rotates between the initial position (not depicted) and the position it assumes when the door is closed (FIG. 1*a*). This ensures that the oven can not be started if the door is not closed.

As mentioned above, there is, however, a disadvantage with this type of locking device in that nothing prevents the door from being opened if, for example, an explosion occurs in the cavity during preparation of a food item.

The above mentioned disadvantage can be avoided by utilizing means receptive to the pressure increase which arises during an explosion and allowing this pressure receptive means, whether mechanically, electrically or in some other manner, to activate catch means so that it is made to assume a catched position.

Therefore in one embodiment of the present invention, a flywheel or an inertia body 10, a catch pawl 11 and a spring 12 are arranged adjacent the rocker wheel. The flywheel 10 is rotatably arranged around an axle, preferably the axle 6, and has an internal resistance against rotation in comparison with the other rotatable parts in the locking device (in this case, the rocker wheel 4), which rotational inertia depends on the mass of the flywheel. The catch pawl 11 is located between the rocker wheel 4 and the flywheel 10 and is rotatably arranged around two axle pins 13 and 14. One axle pin 13 projects from the rocker wheel and the other axle pin 14 projects from the flywheel. The flywheel is acted on by the bias effect of the spring 12, whereby the catch pawl normally assumes a standby position where it does not extend outside the profile or periphery of the rocker wheel, which standby position is maintained when the door is opened in the normal manner. A stop lug 15 is located in the immediate vicinity of the periphery of the rocker wheel, which lug is fixedly secured in the locking device and which the catch pawl can pass by when it is in the standby position.

During rapid opening of the door caused by a sudden pressure increase in the cavity, the flywheel 10 will compress the spring 12 due to its rotational inertia and thereby will not "keep up" with the rotation. The bias effect is thus not sufficiently great for the rocker wheel and the flywheel to rotate equally quickly, the bias being overcome by the retarding power of the inertia body so that the rocker wheel and the flywheel execute a relative rotation in relation to each other. This results in the axle pins 13 and 14 also moving relative to each other. As a consequence, rotation of the catch pawl occurs whereby it ends up projecting outside the periphery of the rocker wheel. The catch pawl can not now pass by the stop lug 15, whereupon the catch pawl assumes a catched position against the stop lug so that the opening movement of the door is stopped.

Figure 1B:
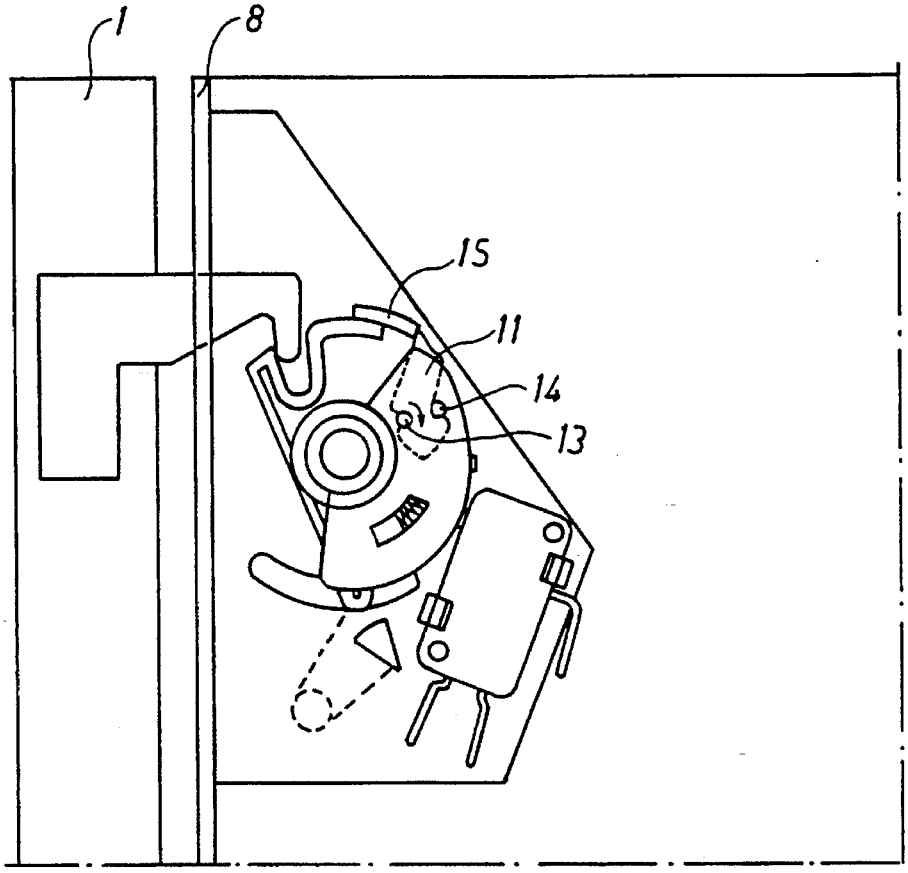

FIG. 1 depicts a situation where an explosion has occurred in the cavity. The door experiences the pressure increase and begins to rapidly open, whereupon the rocker wheel is subjected to a correspondingly rapid rotation. The flywheel rotates more slowly and a relative movement between the axle pins 13 and 14 is obtained. As a consequence of this, the catch pawl is rotated counter-clockwise at the same time as it is shifted somewhat upwardly to the left in the figure, whereby it projects outside the periphery of the rocker wheel. The commenced rapid opening of the door is stopped when the catch pawl engages the stop lug, which is thus the situation illustrated in FIG. 1*b*.

So as not to unintendedly engage the catched position, i.e. if the door is quickly jerked, a running space of around 2 mm is located between the stop lug and the forward part of the catch pawl, when it is in the standby position. A relationship of around 6° on the flywheel to around 20° on the catch pawl is preferred, wherein the pressure increase has to exceed a certain (limit) value in order that the catch pawl will assume the catched position.

During normal opening of the door, the bias effect will be sufficient for the catch pawl to be maintained in the standby position, wherein the catch pawl does not project beyond the periphery of the rocker wheel and accordingly passes by the stop lug without the catched position being assumed.

As mentioned above, a locking device is obtained in this manner which eliminates the need for locking buttons and handles to release the catch pawl during opening of the door, and which additionally ensures a catched position when so needed due to rapid opening of the door, which can be caused by an explosion in the cavity.

Figure 1C:
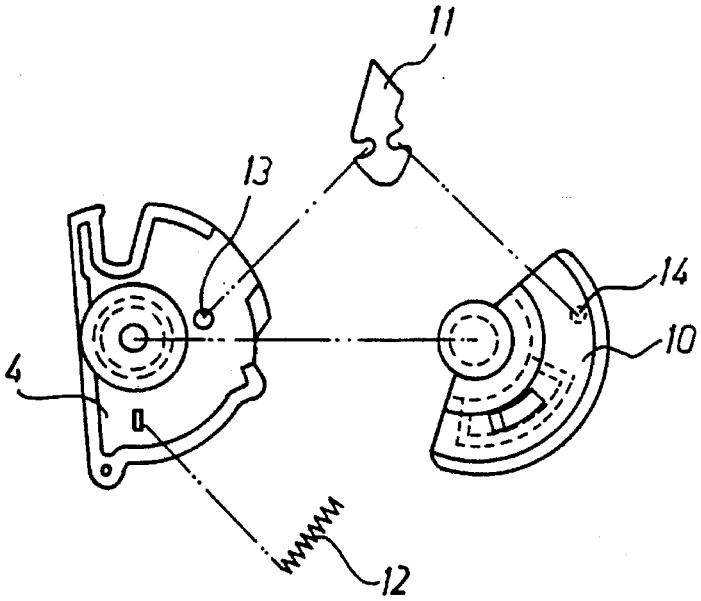

FIG. 1*c* more clearly depicts how the rocker wheel 4, flywheel 10, catch pawl 11 and spring 12 should be arranged in relation to each other.

Figure 2:
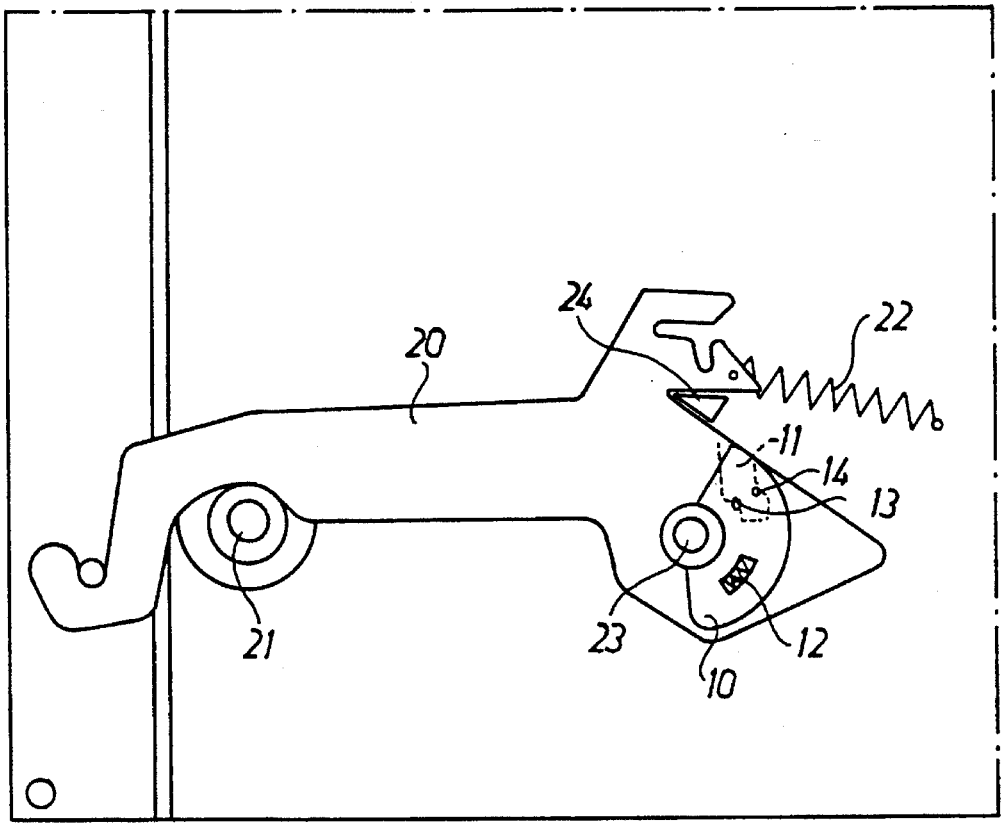
FIG. 2 schematically depicts a side view of a microwave oven which is fitted with a second type of lock device which also has a catch function.

FIG. 2 illustrates a second embodiment. The locking device in this embodiment comprises a balance arm 20 which is arranged to run over an axle 21 when the door is opened, whereby the necessary retention of the door is obtained. The balance arm may additionally be spring biased by a spring 22. This type of locking device is used, inter alia, on doors which open downwards, which are well known to those in the art.

By rotatably arranging a flywheel 10 around an axle 23 adjacent the balance arm, rotatably arranging a catch pawl 11 around two axle pins 13 and 14, between the balance arm and the flywheel, one axle pin 13 projecting from the balance arm and the other axle pin 14 projecting from the flywheel, and fixedly arranging a stop lug 24, the same inventive concept is employed and the same catch function described above in relation to FIGS. 1*a*–1*b*, is obtained. In the same manner as earlier, the standby position of the catch pawl is provided by arranging a spring 12 between the balance arm and the flywheel.

Figure 3:
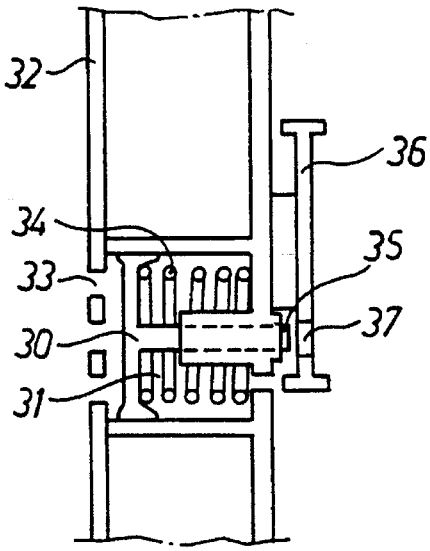
FIG. 3 schematically depicts an alternative embodiment of the invention.

FIG. 3 illustrates a further embodiment of the present invention. A piston 30 is utilized as pressure receptive means in this embodiment, which piston is arranged in a space 31 outside the cavity wall 32.

The pressure is experienced through an opening 33 in the wall 32. The piston means is biased by a spring 34 and normally assumes a standby position abutting the opening in the wall. A catch means 35, in the form of a catch pin, projects from the piston means. A locking device ahving locking member 36 is mounted behind the piston and catch means. When a pressure increase occurs in the cavity, it is experienced by the piston means so that the spring is compressed, wherein the catch means moves towards the locking device and associated locking member 36. If the pressure increase is sufficiently large, the catch means will be received in a hole 37, in i.e. the locking member, this being thereby catched. This train of events occurs before the position of the door manages to be influenced by the pressure by choosing a spring 34 having an appropriate elastic coefficient. The piston means will thus react quickly to a pressure increase, the catched postion being assumed before the door manages to experience the pressure and be opened.

As an alternative to this embodiment, it is also possible to arrange some form of piezoelectric presure receptive means in the space 31 adjacent the opening 33, for instance a piezoelectric member which generates an electric signal. This signal may then, via means to displace the catch means, be used to operate the catch means, whereby a catched position can be assumed when a too large or sudden pressure increase arises in the cavity.

Electricity swiches or microswitches (not depicted in FIG. 3) corresponding to the switch 9 in FIG. 1*a* may also be arranged in the locking device so as to be activated by the catch means 35, whereupom generation of the microwaves is ceased when the door is catched by the catch means.

We claim:

1. A microwave oven comprising a cavity wall defining at least in part a cavity, a door for closing off the cavity and locking device for locking and/or retaining the door, the locking device comprising a locking catch and movable locking member which is actuated by the movement of the door to engage and disengage the locking catch and assume a locked position and an unlocked position upon closing and opening the door, respectively, characterized by:

a safety catch device for preventing the disengagement of the locking catch and the locking member when a sudden pressure increase arises in the cavity, the safety catch device comprising:

catch means moveable between a first and second position for respectively permitting and prevent the movement of the moveable locking member; and pressure receptive means operably connected to the catch means and being responsive to the sudden increase of pressure in the cavity;

whereby upon a sudden increase in pressure, the catch means is moved from the first to the second position, which prevents the movement of the moveable locking member, which prevents the disengagement of the locking catch and the moveable locking member, thus keeping the door closed.

2. A microwave oven according to claim 1, wherein the pressure receptive means being movable and constituted by the door, the catch means being constituted by a movable catch pawl, and the safety catch device further comprising:

an inertia body which is movably attached to the locking member;

a catch member which is fixedly disposed in relation to the locking device, the catch pawl being arranged to be activated by relative movement between the locking member and the inertia body and which normally assumes a non-catched stand-by position and assumes a catched position in engagement with the catch member when the pressure increase occurs and creates said relative movement, whereby continued opening of the door is prevented.

3. A microwave oven according to claim 2, wherein the inertia body is rotatably arranged adjacent the locking member, around a rotation axle; the catch pawl is rotatably arranged between the locking member and the inertia body, around axle pins which are disposed on the locking member and inertia body, respectively, the catch pawl executing a relative rotation in relation to the inertia body when the pressure increase occurs, whereby the catched position is assumed and continued opening of the door is prevented.

4. A microwave oven according to claim 3, wherein the standby position of the catch pawl is effected by retaining means which produces a standby position-restoring force, which force is overcome by the retarding force of the inertia body when the pressure increase occurs in the cavity, and the inertia body has a mass adapted to the restoring force, whereby the catch pawl assumes the catched position and continued opening of the door is prevented.

5. A microwave oven according to claim 4, wherein said restoring means is constituted by a spring which is arranged between the locking member and the inertia body, the locking member and inertia body rotating cooperatively together during normal opening of the door, and the spring being compressed and the locking member and inertia body rotating relatively to each other during rapid opening of the door.

6. A microwave oven according to claim 1, wherein the pressure receptive means is constituted by piston means arranged adjacent the wall of the cavity in a space having an opening into the cavity, the catch means is constituted by a catch pin which is disposed on the piston means, and the safety catch device further comprises:

retaining means which produces a restoring force acting on the piston means and keeping the catch pin in a non-catching position, the piston means and associated catch pin normally assuming the standby position, while the catched position is assumed when the pressure increase occurs and causes the piston means to overcome said force, whereby the catch pin is made to engage the locking member and prevent continued opening of the door.

7. A microwave oven according to claim 6, wherein said retaining means is constituted by a spring which is located between one end of the space and the piston means, and the catched position is provided by the catch pin being received in a hole in the locking member.

8. A microwave oven according to claim 1, wherein the pressure receptive means is constituted by an electronic pressure receptive means, which is arranged in a space in the wall of the cavity adjacent an opening in the wall, the pressure receptive means generating an electric signal in response to a pressure increase in the oven, which signal controls means for making the catch means assume the catched position in engagement with the locking member, whereby opening of the door is prevented.

* * * * *